US012715681B2

(12) United States Patent
Popwell et al.

(10) Patent No.: US 12,715,681 B2
(45) Date of Patent: Aug. 25, 2026

(54) SLOTTED CONTACT LENS PACKAGES AND METHODS OF HANDLING

(71) Applicant: JOHNSON & JOHNSON VISION CARE, INC., Jacksonville, FL (US)

(72) Inventors: Sam Jonathan Popwell, Jacksonville, FL (US); Daniel Graham Ward, Cambridge (GB); Stephen Sams, Cambridge (GB); William Stephen Honey, Bath (GB)

(73) Assignee: JOHNSON & JOHNSON VISION CARE, INC., Jacksonville, FL (US)

( * ) Notice: Subject to any disclaimer, the term of this patent is extended or adjusted under 35 U.S.C. 154(b) by 0 days.

(21) Appl. No.: 18/712,162

(22) PCT Filed: Dec. 8, 2022

(86) PCT No.: PCT/IB2022/061947
§ 371 (c)(1),
(2) Date: May 21, 2024

(87) PCT Pub. No.: WO2023/105470
PCT Pub. Date: Jun. 15, 2023

(65) Prior Publication Data

US 2025/0019147 A1 Jan. 16, 2025

Related U.S. Application Data

(60) Provisional application No. 63/287,271, filed on Dec. 8, 2021.

(51) Int. Cl.
*B65D 85/00* (2006.01)
*B65D 81/22* (2006.01)

(52) U.S. Cl.
CPC ..... *B65D 85/54* (2013.01); *B65D 81/22* (2013.01); *B65D 2585/545* (2013.01)

(58) Field of Classification Search
CPC .. B65D 81/22; B65D 85/54; B65D 2585/545; A45C 11/005
(Continued)

(56) References Cited

U.S. PATENT DOCUMENTS 1,682,719 A * 8/1928 Aldrich ..... A45C 11/04 206/5
3,088,830 A 5/1963 Graham
(Continued)

FOREIGN PATENT DOCUMENTS

BR 202016013147 U2 4/2019
CN 1918048 A 2/2007
(Continued)

OTHER PUBLICATIONS

International Search Report and Written Opinion for International Application No. PCT/IB2022/061946, mailed Mar. 27, 2023, 15 Pages.
(Continued)

*Primary Examiner* — Rafael A Ortiz
(74) *Attorney, Agent, or Firm* — Casimir Jones, S.C.; Thomas J. Lyneis

(57) ABSTRACT

The present invention relates to improved contact lens packages and methods of use. A contact lens package (100) may include a base (110) and a lid (140) connected to the base. The base may include a base cavity (124) that houses a contact lens (150) and packaging solution, and a slot (130) extending through the base from an internal surface (132) to an external surface (134) of the base and in communication with the base cavity. The lid may extend over the external surface of the base and cover the slot when the package is in an unopened state, and the lid may not cover the slot when
(Continued)

the package is in an opened state, such that the contact lens is accessible to a user through the slot when the package is in the opened state.

19 Claims, 3 Drawing Sheets

(58) Field of Classification Search
USPC ..... 206/5, 5.1, 6
See application file for complete search history.

(56) References Cited

U.S. PATENT DOCUMENTS

| | | | | |
|---|---|---|---|---|
| 3,089,500 | A | | 5/1963 | Stalcup |
| 3,159,308 | A | | 12/1964 | Lawrence et al. |
| 3,369,656 | A | | 2/1968 | Skinner, Jr. et al. |
| 3,414,117 | A | | 12/1968 | Leeds |
| 3,473,886 | A | | 10/1969 | Leeds et al. |
| 3,490,806 | A | | 1/1970 | Lopez-Calleja et al. |
| 3,524,455 | A | | 8/1970 | Hoogesteger et al. |
| 3,584,908 | A | | 6/1971 | Ray et al. |
| 3,977,517 | A | | 8/1976 | Kadlecik et al. |
| 4,187,574 | A | | 2/1980 | Wrue |
| 4,392,569 | A | | 7/1983 | Shoup |
| 4,415,076 | A | | 11/1983 | Campbell |
| 4,444,307 | A | | 4/1984 | Jermyn |
| 4,495,313 | A | | 1/1985 | Larsen |
| 4,512,601 | A | | 4/1985 | Jacobstein |
| 4,659,782 | A | | 4/1987 | Spinelli |
| 4,659,783 | A | | 4/1987 | Spinelli |
| 4,691,820 | A | | 9/1987 | Martinez |
| 4,889,664 | A | | 12/1989 | Kindt-Larsen et al. |
| 4,942,959 | A | | 7/1990 | Sauber et al. |
| 4,951,811 | A | * | 8/1990 | Lines ..... A45C 11/046 206/5 |
| 4,984,682 | A | * | 1/1991 | Cummins ..... A45C 11/04 206/5 |
| 4,986,414 | A | | 1/1991 | Ashley et al. |
| 5,031,622 | A | | 7/1991 | Lahaye |
| 5,039,459 | A | | 8/1991 | Kindt-Larsen et al. |
| 5,053,208 | A | | 10/1991 | Seamons et al. |
| 5,099,987 | A | | 3/1992 | Bieri |
| 5,227,039 | A | | 7/1993 | Pankow |
| 5,244,981 | A | | 9/1993 | Seidner et al. |
| 5,314,960 | A | | 5/1994 | Spinelli et al. |
| 5,331,067 | A | | 7/1994 | Seidner et al. |
| 5,371,147 | A | | 12/1994 | Spinelli et al. |
| 5,375,698 | A | | 12/1994 | Ewart et al. |
| 5,407,062 | A | | 4/1995 | Shannon et al. |
| 5,415,275 | A | | 5/1995 | Girimont |
| 5,452,027 | A | | 9/1995 | Tylec |
| 5,474,169 | A | | 12/1995 | Bauman |
| 5,515,964 | A | | 5/1996 | Bauman |
| 5,609,246 | A | | 3/1997 | Borghorst et al. |
| 5,620,088 | A | | 4/1997 | Martin et al. |
| 5,695,049 | A | | 12/1997 | Bauman |
| 5,704,468 | A | | 1/1998 | Lust et al. |
| 5,711,416 | A | | 1/1998 | Bauman |
| 5,722,536 | A | | 3/1998 | Pierce et al. |
| 5,732,990 | A | | 3/1998 | Yavitz et al. |
| 5,760,100 | A | | 6/1998 | Nicolson et al. |
| 5,776,999 | A | | 7/1998 | Nicolson et al. |
| 5,789,461 | A | | 8/1998 | Nicolson et al. |
| 5,849,811 | A | | 12/1998 | Nicolson et al. |
| 5,853,085 | A | | 12/1998 | Luttrell |
| 5,965,631 | A | | 10/1999 | Nicolson et al. |
| 5,998,498 | A | | 12/1999 | Vanderlaan et al. |
| 6,010,001 | A | | 1/2000 | Osborn, III |
| 6,087,415 | A | | 7/2000 | Vanderlaan et al. |
| 6,138,212 | A | | 10/2000 | Chiacchia et al. |
| 6,138,312 | A | | 10/2000 | Cummings |
| 6,253,912 | B1 | | 7/2001 | O'Neill et al. |
| 6,260,695 | B1 | | 7/2001 | Tasber et al. |
| 6,276,797 | B1 | | 8/2001 | Shannon |
| 6,280,530 | B1 | | 8/2001 | Pankow |
| 6,286,666 | B1 | | 9/2001 | Umdasch |
| 6,289,907 | B1 | | 9/2001 | Horian |
| RE37,558 | E | | 2/2002 | Abrams et al. |
| 6,367,929 | B1 | | 4/2002 | Maiden et al. |
| 6,401,915 | B1 | | 6/2002 | Faxe |
| 6,572,165 | B2 | | 6/2003 | Faxe et al. |
| 6,822,016 | B2 | | 11/2004 | McCabe et al. |
| 6,867,245 | B2 | | 3/2005 | Iwata et al. |
| 6,943,203 | B2 | | 9/2005 | Vanderlaan et al. |
| 7,086,526 | B2 | | 8/2006 | Newman |
| 7,225,919 | B2 | | 6/2007 | Hamilton |
| 7,247,692 | B2 | | 7/2007 | Laredo |
| 7,249,848 | B2 | | 7/2007 | Laredo et al. |
| 7,275,275 | B2 | | 10/2007 | Pankow et al. |
| 7,398,877 | B1 | | 7/2008 | Nelson et al. |
| 7,410,050 | B2 | | 8/2008 | Py et al. |
| 7,426,993 | B2 | | 9/2008 | Coldrey et al. |
| 7,441,650 | B2 | | 10/2008 | Tanaka et al. |
| 7,461,740 | B2 | | 12/2008 | Newman |
| 7,540,376 | B2 | | 6/2009 | Mahieu et al. |
| 7,553,880 | B2 | | 6/2009 | Nicolson et al. |
| 7,666,921 | B2 | | 2/2010 | McCabe et al. |
| 7,786,185 | B2 | | 8/2010 | Rathore et al. |
| 7,819,241 | B2 | | 10/2010 | Post-Smith et al. |
| 7,832,551 | B2 | | 11/2010 | Newman et al. |
| 7,832,552 | B2 | | 11/2010 | Newman |
| 7,850,002 | B2 | | 12/2010 | Newman |
| 7,938,255 | B2 | | 5/2011 | Newman |
| 7,956,131 | B2 | | 6/2011 | Arnold et al. |
| 8,022,158 | B2 | | 9/2011 | Rathore et al. |
| 8,104,608 | B2 | | 1/2012 | Newman |
| D658,077 | S | | 4/2012 | Newman |
| 8,251,205 | B2 | | 8/2012 | Azera |
| 8,273,802 | B2 | | 9/2012 | Laredo et al. |
| 8,399,538 | B2 | | 3/2013 | Steffen et al. |
| 8,450,387 | B2 | | 5/2013 | Mccabe et al. |
| 8,470,906 | B2 | | 6/2013 | Rathore et al. |
| 8,487,058 | B2 | | 7/2013 | Liu et al. |
| 8,507,577 | B2 | | 8/2013 | Zanini et al. |
| D690,207 | S | | 9/2013 | Newman |
| 8,637,621 | B2 | | 1/2014 | Iwata et al. |
| 8,703,891 | B2 | | 4/2014 | Broad |
| 8,833,548 | B2 | | 9/2014 | Hsieh et al. |
| 8,881,892 | B1 | | 11/2014 | Linhardt et al. |
| 8,937,110 | B2 | | 1/2015 | Alli et al. |
| 8,937,111 | B2 | | 1/2015 | Alli et al. |
| 8,940,812 | B2 | | 1/2015 | Reboul et al. |
| 9,044,075 | B2 | | 6/2015 | Linhardt et al. |
| 9,056,878 | B2 | | 6/2015 | Fujisawa et al. |
| 9,057,821 | B2 | | 6/2015 | Broad et al. |
| 9,067,720 | B2 | | 6/2015 | Howell et al. |
| 9,095,195 | B2 | | 8/2015 | Mori |
| 9,125,808 | B2 | | 9/2015 | Alli et al. |
| 9,140,825 | B2 | | 9/2015 | Alli et al. |
| 9,156,934 | B2 | | 10/2015 | Alli et al. |
| 9,170,349 | B2 | | 10/2015 | Mahadevan et al. |
| 9,244,196 | B2 | | 1/2016 | Scales et al. |
| 9,244,197 | B2 | | 1/2016 | Alli et al. |
| 9,260,544 | B2 | | 2/2016 | Rathore et al. |
| 9,297,928 | B2 | | 3/2016 | Molock et al. |
| 9,297,929 | B2 | | 3/2016 | Scales et al. |
| 9,320,566 | B1 | | 4/2016 | Alston, Jr. et al. |
| 9,358,736 | B2 | | 6/2016 | Wang et al. |
| 9,576,609 | B2 | | 2/2017 | Huang et al. |
| 9,663,253 | B2 | | 5/2017 | Federici et al. |
| 9,668,558 | B2 | | 6/2017 | Clamp et al. |
| 9,701,458 | B2 | | 7/2017 | Barrows et al. |
| D804,323 | S | | 12/2017 | Harrison et al. |
| D805,920 | S | | 12/2017 | Clamp |
| 9,839,270 | B2 | | 12/2017 | Howell et al. |
| D813,537 | S | | 3/2018 | Miura et al. |
| 10,092,075 | B2 | | 10/2018 | Barre et al. |
| 10,138,042 | B2 | | 11/2018 | Fawdington et al. |
| 10,194,724 | B2 | | 2/2019 | Newman |
| 10,364,082 | B2 | | 7/2019 | Coon et al. |
| 10,368,621 | B2 | | 8/2019 | Barre et al. |
| 10,463,127 | B2 | | 11/2019 | Kim |
| 10,577,166 | B2 | | 3/2020 | Barrows et al. |
| 10,661,964 | B2 | | 5/2020 | Tokarski et al. |

(56) References Cited

U.S. PATENT DOCUMENTS

| | | | | |
|---|---|---|---|---|
| D899,080 | S | 10/2020 | Yasuda et al. | |
| D899,081 | S | 10/2020 | Yamamoto et al. | |
| 10,901,236 | B2 | 1/2021 | Schweizer et al. | |
| 10,926,944 | B2 | 2/2021 | Huang | |
| 11,071,644 | B2 | 7/2021 | Greenwood et al. | |
| 11,077,969 | B2 | 8/2021 | Newman | |
| 11,136,176 | B2 | 10/2021 | Almond et al. | |
| 11,229,266 | B2 | 1/2022 | Almond et al. | |
| 11,628,998 | B2 | 4/2023 | Ho et al. | |
| 11,649,099 | B2 | 5/2023 | Ellis et al. | |
| 11,751,654 | B2 | 9/2023 | Lansing et al. | |
| 2001/0017271 | A1 | 8/2001 | Yavitz | |
| 2002/0158477 | A1 | 10/2002 | Faxe et al. | |
| 2002/0163212 | A1 | 11/2002 | Py | |
| 2004/0134005 | A1 | 7/2004 | Pankow et al. | |
| 2004/0150238 | A1 | 8/2004 | Jeoung | |
| 2004/0238380 | A1 | 12/2004 | Newman | |
| 2005/0087453 | A1 | 4/2005 | Mahieu et al. | |
| 2005/0103649 | A1 | 5/2005 | Vulcu et al. | |
| 2005/0218012 | A1 | 10/2005 | Tanaka et al. | |
| 2006/0011496 | A1* | 1/2006 | Mangabeira Nunez | A45C 11/005 206/5.1 |
| 2006/0201103 | A1 | 9/2006 | Tokarski et al. | |
| 2006/0213783 | A1 | 9/2006 | Tokarski et al. | |
| 2006/0213784 | A1 | 9/2006 | Tokarski et al. | |
| 2006/0219577 | A1 | 10/2006 | Newman | |
| 2006/0260956 | A1 | 11/2006 | Stachowski et al. | |
| 2006/0260957 | A1 | 11/2006 | Hamilton | |
| 2007/0000792 | A1 | 1/2007 | Newman et al. | |
| 2007/0164576 | A1 | 7/2007 | Kim | |
| 2008/0011619 | A1 | 1/2008 | Newman | |
| 2008/0047848 | A1 | 2/2008 | Tokarski et al. | |
| 2008/0078681 | A1 | 4/2008 | Newman | |
| 2008/0170201 | A1 | 7/2008 | Filippo | |
| 2009/0121370 | A1 | 5/2009 | Barrows et al. | |
| 2009/0139879 | A1 | 6/2009 | Tokarski et al. | |
| 2009/0200182 | A1 | 8/2009 | Post-Smith et al. | |
| 2010/0048847 | A1 | 2/2010 | Broad | |
| 2010/0072082 | A1 | 3/2010 | Kang | |
| 2010/0187140 | A1 | 7/2010 | Tokarski et al. | |
| 2011/0017243 | A1 | 1/2011 | Voss et al. | |
| 2012/0267262 | A1 | 10/2012 | Wang et al. | |
| 2013/0091613 | A1 | 4/2013 | Meltzner | |
| 2013/0277242 | A1 | 10/2013 | Mori | |
| 2014/0001059 | A1 | 1/2014 | Hsieh et al. | |
| 2014/0027462 | A1 | 1/2014 | Willat et al. | |
| 2014/0027465 | A1 | 1/2014 | Howell et al. | |
| 2014/0246337 | A1 | 9/2014 | Newman | |
| 2015/0014187 | A1 | 1/2015 | Gilman et al. | |
| 2015/0150346 | A1 | 6/2015 | Yasuda et al. | |
| 2015/0173474 | A1 | 6/2015 | Barrows et al. | |
| 2015/0296943 | A1 | 10/2015 | Howell et al. | |
| 2016/0198825 | A1 | 7/2016 | Fawdington et al. | |
| 2017/0172269 | A1 | 6/2017 | Lin | |
| 2018/0134475 | A1* | 5/2018 | Newman | B65B 31/04 |
| 2018/0340622 | A1 | 11/2018 | Godfrey | |
| 2019/0046353 | A1 | 2/2019 | Greenwood et al. | |
| 2019/0133275 | A1 | 5/2019 | Newman | |
| 2019/0270543 | A1* | 9/2019 | Namazie | B65D 5/6611 |
| 2020/0229560 | A1 | 7/2020 | Almond et al. | |
| 2020/0229561 | A1 | 7/2020 | Almond et al. | |
| 2020/0229562 | A1 | 7/2020 | Almond et al. | |
| 2020/0229563 | A1 | 7/2020 | Almond et al. | |
| 2020/0231351 | A1 | 7/2020 | Almond et al. | |
| 2020/0383440 | A1 | 12/2020 | Newman | |
| 2021/0139229 | A1 | 5/2021 | Huang | |
| 2022/0330671 | A1 | 10/2022 | Bruchon et al. | |
| 2022/0365368 | A1 | 11/2022 | Greenwood et al. | |
| 2023/0083028 | A1 | 3/2023 | Popwell et al. | |
| 2023/0276917 | A1 | 9/2023 | Popwell et al. | |

FOREIGN PATENT DOCUMENTS

| | | | | |
|---|---|---|---|---|
| CN | 101662967 | A | 3/2010 | |
| CN | 111759065 | A | 10/2020 | |
| DE | 4415003 | C1 | 6/1995 | |
| DE | 202006004323 | U1 | 5/2006 | |
| EP | 0269367 | A2 | 6/1988 | |
| EP | 3045071 | A1 | 7/2016 | |
| EP | 2768465 | B1 | 9/2019 | |
| FR | 2712398 | A1 | 5/1995 | |
| FR | 2777360 | A1 | 10/1999 | |
| GB | 2551530 | A | 12/2017 | |
| JP | H01279222 | A | 11/1989 | |
| JP | H10313928 | A | 12/1998 | |
| JP | 2001046134 | A | 2/2001 | |
| JP | 5184925 | B2 | 4/2013 | |
| JP | 2014218255 | A | 11/2014 | |
| JP | 6004912 | B2 | 10/2016 | |
| JP | 2016179837 | A | 10/2016 | |
| JP | 6129238 | B2 | 5/2017 | |
| JP | 6129239 | B2 | 5/2017 | |
| JP | 6339322 | B2 | 6/2018 | |
| KR | 100768522 | B1 | 10/2007 | |
| KR | 20080066930 | A | 7/2008 | |
| KR | 20080090252 | A | 10/2008 | |
| KR | 20090060075 | A | 6/2009 | |
| KR | 20100002433 | A | 1/2010 | |
| KR | 101495874 | B1 | 2/2015 | |
| KR | 20160064382 | A | 6/2016 | |
| KR | 20170079398 | * | 7/2017 | |
| KR | 20190003113 | U | 12/2019 | |
| KR | 200490803 | Y1 | 2/2020 | |
| NL | 2000268 | C2 | 4/2008 | |
| TW | 200930318 | A | 7/2009 | |
| TW | D159617 | S | 4/2014 | |
| TW | D172590 | S | 12/2015 | |
| WO | WO-9921519 | A1 | 5/1999 | |
| WO | WO-02088780 | A2 | 11/2002 | |
| WO | WO-03022321 | A2 | 3/2003 | |
| WO | WO-2005006062 | A1 | 1/2005 | |
| WO | WO-2005055760 | A1 | 6/2005 | |
| WO | WO-2005073105 | A2 | 8/2005 | |
| WO | WO-2005082721 | A2 | 9/2005 | |
| WO | WO-2006068583 | A1 | 6/2006 | |
| WO | WO-2006105179 | A1 | 10/2006 | |
| WO | WO-2008061992 | A2 | 5/2008 | |
| WO | WO-2008120954 | A1 | 10/2008 | |
| WO | WO-2009059231 | A1 | 5/2009 | |
| WO | WO-2009069265 | A1 | 6/2009 | |
| WO | WO-2012165209 | A1 | 12/2012 | |
| WO | WO-2012168964 | A1 | 12/2012 | |
| WO | WO-2013058712 | A1 | 4/2013 | |
| WO | WO-2013134547 | A1 | 9/2013 | |
| WO | WO-2013136361 | A1 | 9/2013 | |
| WO | WO-2013153582 | A1 | 10/2013 | |
| WO | WO-2014185354 | A1 | 11/2014 | |
| WO | WO-2014195588 | A1 | 12/2014 | |
| WO | WO-2015150704 | A1 | 10/2015 | |
| WO | WO-2017098168 | A1 * | 6/2017 | B65D 81/05 |
| WO | WO-2017137738 | A1 | 8/2017 | |
| WO | 2017220684 | A1 | 12/2017 | |
| WO | WO-2019013199 | A1 | 1/2019 | |
| WO | WO-2020152444 | A1 | 7/2020 | |
| WO | WO-2020152446 | A1 | 7/2020 | |
| WO | WO-2021176760 | A1 | 9/2021 | |
| WO | WO-2021260353 | A1 | 12/2021 | |
| WO | WO-2022054031 | A2 | 3/2022 | |
| WO | WO-2022054033 | A2 | 3/2022 | |
| WO | WO-2022123525 | A1 | 6/2022 | |

OTHER PUBLICATIONS

International Search Report and Written Opinion for International Application No. PCT/IB2022/061947, mailed Feb. 15, 2023, 14 Pages.

International Search Report and Written Opinion for International Application No. PCT/IB2022/062129, mailed Mar. 16, 2023, 14 Pages.

(56) References Cited

OTHER PUBLICATIONS

International Search Report and Written Opinion for International Application No. PCT/IB2022/062305, mailed Mar. 28, 2023, 12 Pages.

* cited by examiner

SLOTTED CONTACT LENS PACKAGES AND METHODS OF HANDLING

I. BACKGROUND OF THE INVENTION

In a conventional contact lens package, the contact lens typically sits in a molded plastic base having a cavity (or "bowl") that houses the contact lens in a concave-side-up orientation. As a result, the user experience for transferring a contact lens from the package to an eye generally involves the user "fishing" the contact lens out of the bowl with a finger and then flipping the lens so that it is in the correct orientation on the finger for placement on the eye. This process requires touching the lens multiple times, which can transfer contaminants or pathogens from the hand to the lens and ultimately to the eye. Not only is this handling experience unsanitary, but it is also unduly cumbersome, messy, and mechanically stressful to the lens, which can tear, rip, or distort when overly manipulated. While some packages have been designed to present the lens in a convex-side-up orientation to obviate the need for flipping the lens, they often still require the lens to be "fished" from the packaging solution or otherwise necessitate manipulation of the lens and/or multiple touches of the lens to achieve transfer of the lens to the eye.

In view of the growing awareness around ocular health and the customer demand for a more convenient experience, a need has arisen for contact lens packaging that enables a less messy and more sanitary contact lens handling process. In one respect, it would be ideal to provide wearers of contact lenses with a "single touch" package—that is, a package whereby the wearer of contact lenses can take the lens from the lens storage package with a single touch of one of his or her fingers, and then, with this single touch, position the lens correctly on the eye. In such a design, there would be no need for transfer and manipulation of the lens from one finger to another before placing the lens on the eye. Providing such a single touch package would not only streamline the lens preparation and insertion process; it would also diminish the possibility of dropping the lens or exposing the lens to additional bacteria-on a wearer's other fingers as the lens is being prepared for orientation and insertion onto the eye, and it also reduces the possibility of touching the side of the lens which is intended to contact the eye.

Design of a single touch lens package faces some distinct challenges. The wearer ideally should be able to consistently position the lens to adhere to the finger during removal from the package. Further, the single touch package ideally should not result in an inordinate increase in the cost of goods over current contact lens packages, as this could result in increased costs to the wearer community. The package should not make it difficult to hold the lens when removed from the package. Additionally, if the configuration of the package were to maintain, or even reduce the volume of solution needed to package the lens, this would reduce the ecological impact of the lens package. Similarly, it would be beneficial if all or part of the package could be made of recycled materials, and/or recyclable in whole or part.

In addition, it would be advantageous if the package were composed of materials that are already approved by the various regulatory bodies and ideally did not require a change in solution chemistry or lens composition. Optimally, as well, the functionality of the package preferably does not incorporate any electronics or other electrical components if such components could adversely affect performance of either the package or the lens.

Thus, there remains a need for contact lens packages which provide a single-touch lens removal experience.

II. SUMMARY

It has now been found that some or all the foregoing and related objects may be attained in a contact lens package having one or more aspects described herein. According to certain embodiments, a contact lens package can include a base having a base cavity that houses a contact lens and packaging solution, and a slot extending through the base and in communication with the base cavity. As described herein, when the contact lens package is in an opened state, the contact lens may be accessible to a user through the slot, allowing the user to engage the contact lens through the slot to facilitate removal of the contact lens from the package. In certain embodiments, a convex surface of the contact lens may face the slot such that the user engages the convex surface, allowing a single-touch user experience, as described-herein. The present disclosure provides various embodiments of contact lens packages, methods of packaging a contact lens, and methods of opening a contact lens package.

In one aspect, a contact lens package is provided. The contact lens package may include a base and a lid connected to the base. The base may include a base cavity that houses a contact lens and packaging solution, and a slot extending through the base from an internal surface to an external surface of the base and in communication with the base cavity. The lid may extend over the external surface of the base and cover the slot when the package is in an unopened state.

In some embodiments, the lid may not cover the slot when the package is in an opened state, such that the contact lens is accessible to a user through the slot when the package is in the opened state. In some embodiments, the base cavity may house the contact lens such that a convex surface of the contact lens faces the slot. In some embodiments, the base may include a bowl that forms at least a portion of the base cavity, and the slot may extend through the bowl from the internal surface to the external surface of the base. In some embodiments, the slot may extend from an end of the base and terminate at an intermediate region of the bowl. In some embodiments, the slot may extend from an end of the base and terminate at an intermediate region of the base. In some embodiments, the lid may extend over the end of the base when the package is in the unopened state, and the lid may not extend over the end of the base when the package is in an opened state. In some embodiments, the end of the base may be open and configured to allow the contact lens to pass therethrough when the package is in an opened state. In some embodiments, the internal surface may be a concave surface, and the external surface may be a convex surface. In some embodiments, the base may be substantially rigid, and the lid may be flexible.

In another aspect, a contact lens package is provided. The contact lens package may include a base and a lid connected to the base. The base may include a base cavity that houses a contact lens and packaging solution, and a slot extending through the base from an internal surface to an external surface of the base and in communication with the base cavity. The base cavity may house the contact lens such that a convex surface of the contact lens faces the slot.

In some embodiments, the lid may extend over the external surface of the base and cover the slot when the package is in an unopened state. In some embodiments, the lid may not cover the slot when the package is in an opened state, such that the contact lens is accessible to a user through the slot when the package is in the opened state. In some embodiments, the base may include a bowl that forms at least a portion of the base cavity, and the slot may extend through the bowl from the internal surface to the external surface of the base. In some embodiments, the slot may extend from an end of the base and terminate at an intermediate region of the bowl. In some embodiments, the slot may extend from an end of the base and terminate at an intermediate region of the base. In some embodiments, the lid may extend over the end of the base when the package is in the unopened state, and the lid may not extend over the end of the base when the package is in an opened state. In some embodiments, the end of the base may be open and configured to allow the contact lens to pass therethrough when the package is in an opened state. In some embodiments, the internal surface may be a concave surface, and the external surface may be a convex surface. In some embodiments, the base may be substantially rigid, and the cover may be flexible.

In still another aspect, a method of packaging a contact lens is provided. The method may include providing a base including a base cavity and a slot extending through the base from an internal surface to an external surface of the base and in communication with the base cavity, disposing a contact lens and packaging solution within the base cavity, and connecting a lid to the base such that the lid extends over the external surface of the base and covers the slot.

In some embodiments, the contact lens may be disposed within the base cavity such that a convex surface of the contact lens faces the slot. In some embodiments, the base may include a bowl that forms at least a portion of the base cavity, and the slot may extend through the bowl from the internal surface to the external surface of the base. In some embodiments, the slot may extend from an end of the base and terminate at an intermediate region of the base, and the lid may extend over the end of the base. In some embodiments, the internal surface may be a concave surface, and the external surface may be a convex surface.

In another aspect, a method of opening a contact lens package is provided. The method may include holding a base of the package, with the base including a base cavity that houses a contact lens and packaging solution, and a slot extending through the base from an internal surface to an external surface of the base. The method also may include at least partially removing a lid of the package from the external surface of the base such that the slot is not covered by the lid, engaging the contact lens through the slot, and sliding the contact lens out of the base cavity via the engagement through the slot.

In some embodiments, the base cavity may house the contact lens such that a convex surface of the contact lens faces the slot. In some embodiments, the base may include a bowl that forms at least a portion of the base cavity, and the slot may extend through the bowl from the internal surface to the external surface of the base. In some embodiments, the slot may extend from an open end of the base and terminate at an intermediate region of the base, and sliding the contact lens out of the base cavity may include sliding the contact lens through the open end of the base. In some embodiments, the internal surface may be a concave surface, and the external surface may be a convex surface.

These and other aspects and improvements of the present disclosure will become apparent to one of ordinary skill in the art upon review of the following detailed description when taken in conjunction with the accompanying drawings and the appended claims.

III. BRIEF DESCRIPTION OF THE DRAWINGS

The foregoing and other features and advantages of the invention will be apparent from the following, more particular description of certain embodiments of the present disclosure, as illustrated in the accompanying drawings.

Figure 1A:
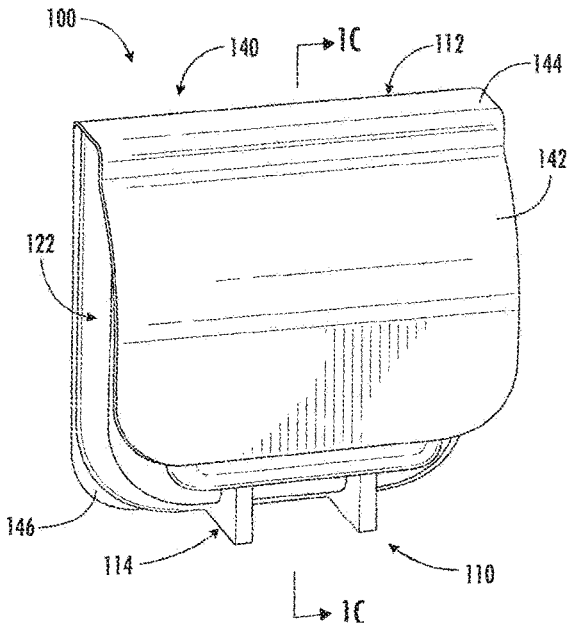
FIG. 1A is a front perspective view of an example contact lens package in accordance with embodiments of the disclosure, showing the contact lens package in a vertical orientation and an unopened state.
Figure 2A:
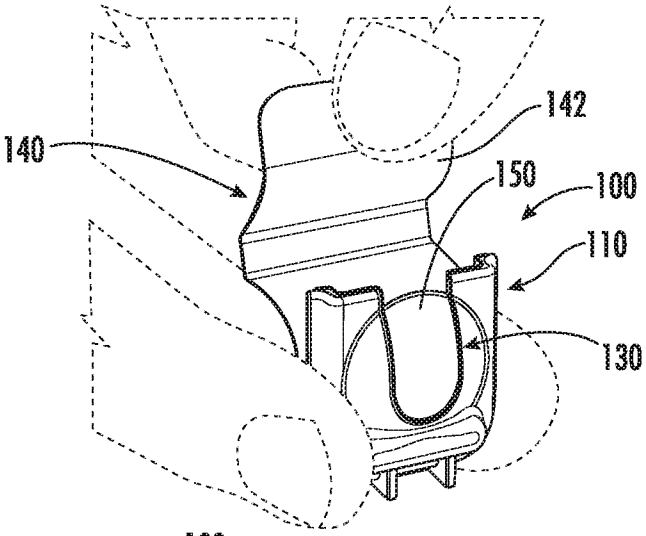
Figure 2C:
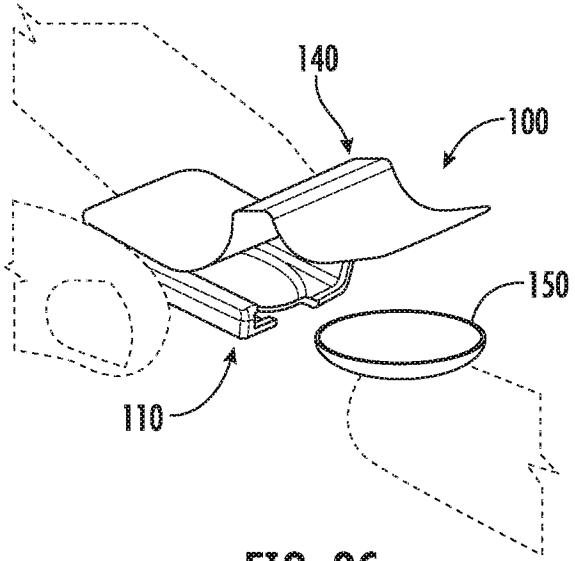
Figure 2B:
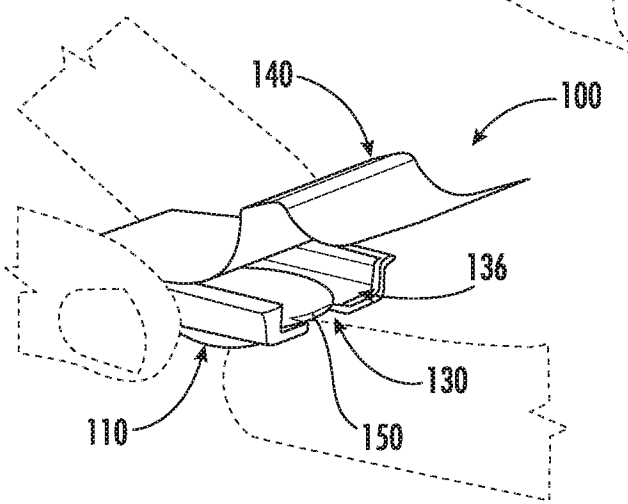

FIGS. 2A-2C are perspective views illustrating an example method of opening the contact lens package of FIG. 1A in accordance with embodiments of the disclosure. FIG. 2A shows a user holding a base of the contact lens package and at least partially removing a lid of the contact lens package from the base. FIG. 2B shows the user engaging a contact lens through a slot of the base.

FIG. 2C shows the user sliding the contact lens out of a base cavity of the base via the engagement through the slot.

IV. DETAILED DESCRIPTION

Reference will now be made in detail to representative embodiments illustrated in the accompanying drawings wherein reference numerals indicate certain elements. The following descriptions are not intended to limit the myriad embodiments to one preferred embodiment. To the contrary, it is intended to cover alternatives, modifications, and equivalents as can be included within the spirit and scope of the described embodiments as defined by the appended claims.

References to "one embodiment," "an embodiment," "some embodiments," "an example embodiment," etc., indicate that the embodiment described may include a particular feature, structure, aspect, or characteristic, but every embodiment may not necessarily include the particular feature, structure, or characteristic. Moreover, such phrases are not necessarily referring to the same embodiment. Further, when a particular feature, structure, aspect, or characteristic is described in connection with an embodiment, it is submitted that it is within the knowledge of one skilled in the art to effect such feature, structure, or characteristic in connection with other embodiments whether or not explicitly described.

As used herein, the following terms have the following meaning. A benefit of the certain embodiments the present invention is that they facilitate consistent single-touch lens transfer from the package to a wearer's finger, and then from the finger to the wearer's eye without the lens inverting, falling off the finger or further manipulation.

Lens(es) or contact lens(es) refer to ophthalmic devices that reside on the eye. They have a generally hemispheric shape and can provide optical correction, cosmetic enhancement, UV blocking and visible light or glare reduction, therapeutic effect, including wound healing, delivery of drugs or neutraceuticals, diagnostic evaluation or monitoring, or any combination thereof. The term lens includes soft hydrogel contact lenses, which are generally provided to the consumer in a package in the hydrated state, and have a relatively low moduli, which allows them to conform to the cornea. Contact lenses suitable for use with the packages of the present invention include all hydrated contact lenses, including conventional and silicone hydrogel contact lenses.

A hydrogel is a hydrated crosslinked polymeric system that contains water in an equilibrium state, and may contain at least about 25%, or at least 35% water in the hydrated state. Hydrogels typically are oxygen permeable and biocompatible, making them excellent materials for producing contact lenses.

Conventional hydrogel contact lenses do not contain silicone containing components, and generally have higher water content, lower oxygen permeability, moduli, and shape memories than silicone hydrogels. Conventional hydrogels are prepared from monomeric mixtures predominantly containing hydrophilic monomers, such as 2-hydroxyethyl methacrylate ("HEMA"), N-vinyl pyrrolidone ("NVP") or polyvinyl alcohols. U.S. Pat. Nos. 4,495,313, 4,889,664 and 5,039,459 disclose the formation of conventional hydrogels. Conventional hydrogels may be ionic or non-ionic and include polymacon, etafilcon, nelfilcon, ocufilcon lenefilcon and the like. The oxygen permeability of these conventional hydrogel materials is typically below 20-30 barrers.

Silicon hydrogel formulations include balafilcon samfilcon, lotrafilcon A and B, delfilcon, galyfilcon, senofilcon A, B and C, narafilcon, comfilcon, formofilcon, riofilcon, fanfilcon, stenfilcon, somofilcon, kalifilcon and the like. "Silicone hydrogels" refer to polymeric networks made from at least one hydrophilic component and at least one silicone-containing component. Silicone hydrogels may have moduli in the range of 60-200, 60-150 or 80-130 psi, water contents in the range of 20 to 60%. Examples of silicone hydrogels include acquafilcon, asmofilcon, balafilcon, comfilcon, delefilcon, enfilcon, fanfilcon, formofilcon, galyfilcon, lotrafilcon, narafilcon, riofilcon, samfilcon, senofilcon, somofilcon, and stenfilcon, verofilcon, including all of their variants, as well as silicone hydrogels as prepared in U.S. Pat. Nos. 4,659,782, 4,659,783, 5,244,981, 5,314,960, 5,331,067, 5,371,147, 5,998,498, 6,087,415, 5,760,100, 5,776,999, 5,789,461, 5,849,811, 5,965,631, 6,367,929, 6,822,016, 6,867,245, 6,943,203, 7,247,692, 7,249,848, 7,553,880, 7,666,921, 7,786,185, 7,956,131, 8,022,158, 8,273,802, 8,399,538, 8,470,906, 8,450,387, 8,487,058, 8,507,577, 8,637,621, 8,703,891, 8,937,110, 8,937,111, 8,940,812, 9,056,878, 9,057,821, 9,125,808, 9,140,825, 9,156,934, 9,170,349, 9,244,196, 9,244,197, 9,260,544, 9,297,928, 9,297,929 as well as WO 03/22321, WO 2008/061992, and US 2010/0048847. These patents are hereby incorporated by reference in their entireties. Silicone hydrogels may have higher shape memory than conventional contact Jenses.

Hydrogel lenses are viscoelastic materials. Contact lenses can form optical distortions if the lens interacts with either the package or any air bubble in the package. The extent of the optical distortions, and the length of time needed for the distortions to relax out will vary depending on the chemistry, and to a lesser extent, geometry of the lens. Conventional lens materials, such as polyhydroxyethyl methacrylate-based lenses like etafilcon A or polymacon have low loss modulus and tan delta compared to silicone hydrogels and may form fewer and less severe optical distortions as a result of contact with packaging. The incorporation of silicones (which generally increase the bulk elastic response), wetting agents such as PVP (which generally increase the viscous response) or coatings of conventional hydrogel materials (which may lower the elastic response at the lens interface) can alter the lens viscoelastic properties. Conventional hydrogel contact lenses and silicone hydrogel contact lenses having short or stiff crosslinking agents and or stiffening agent have short shape memories and may be less susceptible to deformation during storage. As used herein, high or higher shape memory hydrogels display optical distortions from contact with an air bubble or package of at least about 0.18 after 5 weeks of accelerated aging at 55° C. Viscoelastic properties, including loss modulus and tan delta, can be measured using a dynamic mechanical analysis.

The contact lenses can be of any geometry or power, and have a generally hemispherical shape, with a concave posterior side which rests against the eye when in use and a convex anterior side which faces away from the eye and is contacted by the eyelid during blinking.

The center or apex of the lens is the center of the lens optic zone. The optic zone provides optical correction and may have a diameter between about 7 mm and about 10 mm. The lens periphery or lens edge is the edge where the anterior and posterior sides meet.

Embodiments may include a lens support surrounded by a sealable cavity also interchangeably referred to as a chamber. The cavity may have any convenient form and may comprise a package base and at least a lid, each of which are described in detail below. As used herein, the phrases "the lid", "a lid", "the base" and "a base" encompass both the singular and plural. The lid and package base are sealed to each other to form a cavity which holds the contact lens, support and packaging solution in a sterile state during shipping and storage prior to use. The contact lens package is made from materials which are compatible with the contact lens and solution, as well as retortable and biologically inert.

"Film" or "multilayer film" are films used to seal the package and are often referred to as lidstock. Multilayer films used in conventional contact lens packages may be used in the packages of the present invention as the base, a component of the lid, or both. Multilayer films comprise a plurality of layers, including barrier layers, including foil layers, or coatings, seal layers, which seal the film to the rest of the package, and may also comprise additional layers selected from peel initiation layers, lamination layers, and layers that improve other package properties like stiffness, temperature resistance, printability, puncture resistance, barrier resistance to water or oxygen and the like. The multilayer films form a steam sterilizable (retortable) seal. The multilayer film can include PET, BON or OPP films layers to increase stiffness and temperature resistance, or to EVOH or PVDC coatings to improve barrier resistance to oxygen or moisture vapor.

An "unopened state" or "unopened" as used herein refers to a contact lens package that is closed and houses a contact lens in solution.

An "opened state" or "opened" as used herein refers to a contact lens package after the sterile seal has been broken. Depending on the context described herein, the opened state extends to the state of the package when the user has manipulated the package to cause the lens to be lifted out of the packaging solution for transfer by the user.

A "wearer" or "user" as used herein refers to a person opening a contact lens package. The user is generally referred to as the person who both opens the package and transfers the contact lens contained therein to their eye. However, the user in some contexts may be a person handling the lens package on behalf of the wearer, such an eye care provider ("ECP") or another individual demonstrating for or assisting the wearer.

Packaging solution is any physiologically compatible solution, which is compatible with the selected lens material and packaging. Packaging solutions include buffered solutions having a physiological pH, such as buffered saline solutions. The packaging solution may contain known components, including buffers, pH and tonicity adjusting agents, lubricants, wetting agents, nutraceuticals, pharmaceuticals, in package coating components and the like.

The package base may form the bottom of the package. It can be made from any material suitable for packaging medical devices, including plastic. The package base may be made from selected from polymers, rubbers, or plastics that can molded and preferably be injection molded and are compatible with the chemical and physical properties of the lens, packing solution and any additives which may be included therein and sterilization requirements of contact lens manufacture. Examples of suitable materials include polyolefins including polypropylene, and olefin co-polymers, including COPs (Cyclic Olefin Polymer) and COCs, (Cyclic Olefin Co-polymers), and blends thereof.

The packaging lid seals with the base to form a cavity containing at least a portion of the lens support, lens, and packaging solution. The lid may be made from any material suitable for packaging medical devices, including a molded sheet of foil or plastic, laminate films, or plastic. Packages comprising plastic for one structure and foil or laminated films as the other, or packages comprising foil or laminated films as the outer layer for the lid and base are known in the art and are examples of suitable combinations.

References throughout this description to injection molding processes and the use of materials conventionally applied to injection molding should be understood as exemplary. Those of skill in the art will appreciate that other means of manufacture are possible within the scope of the appended claims, including but not limited to alternative molding processes, thermoforming, 3D printing, and the like. Likewise, references to heat seals and heat sealing are exemplary to embodiments described herein. Other means of securing packaging components will be apparent to those skilled in the art, including the use of adhesive, glue, thermal bonding, welding such as heat, ultrasonic or laser welding, or a mechanical trap, and the like.

Figure 1B:
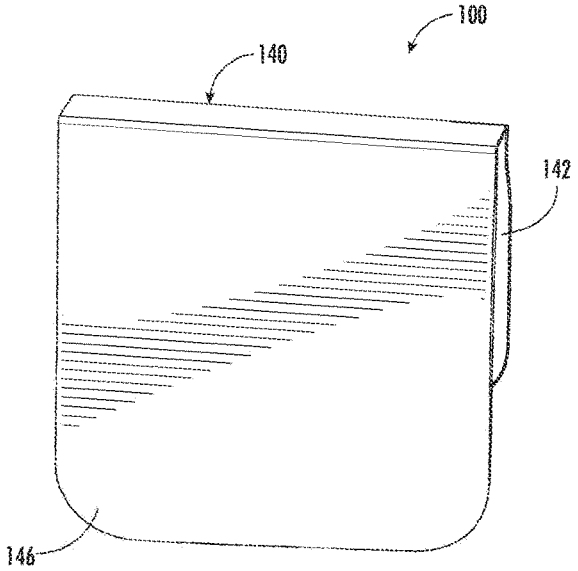
FIG. 1B is a rear perspective view of the contact lens package of FIG. 1A in the vertical orientation and the unopened state.
Figure 1D:
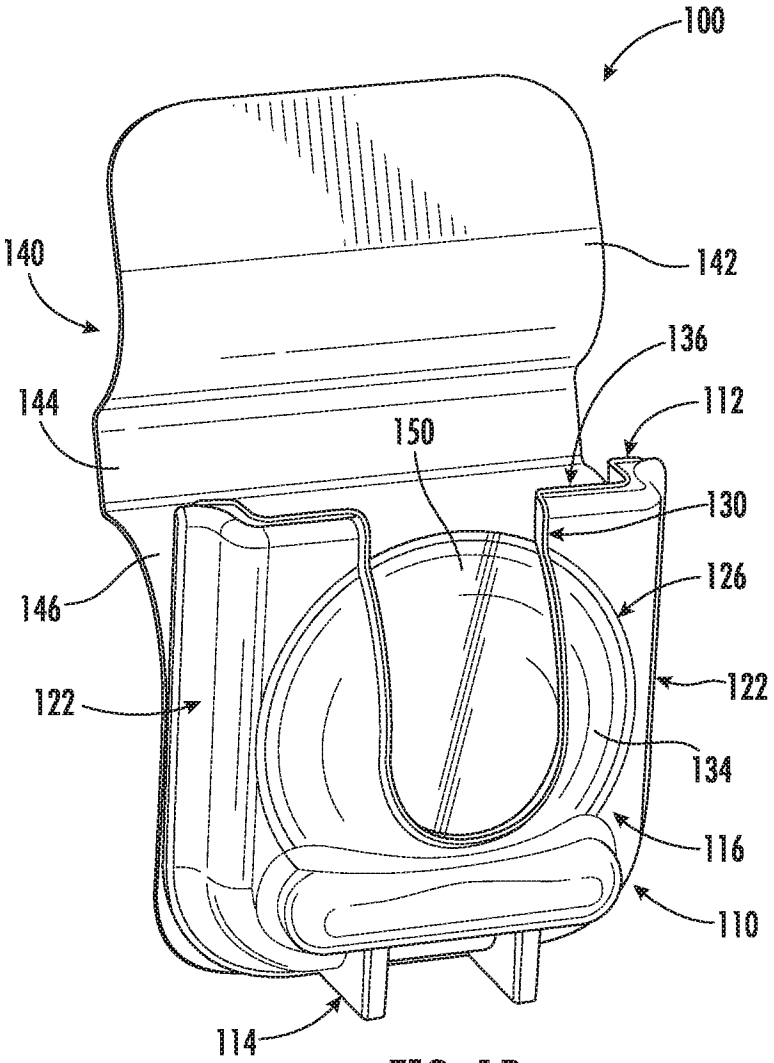
FIG. 1D is a front perspective view of the contact lens package of FIG. 1A in the vertical orientation and an opened state.
Figure 1C:
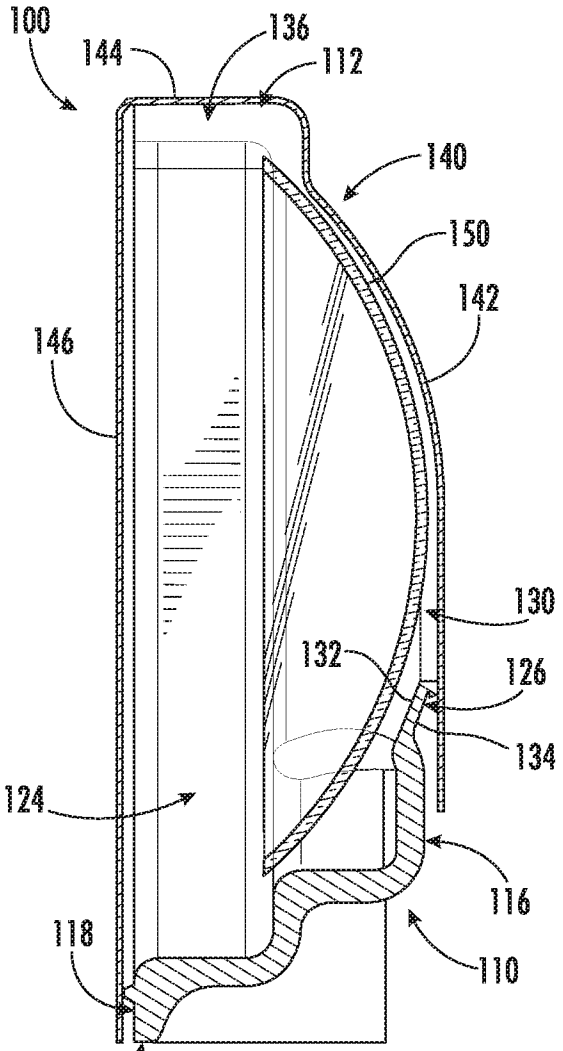
FIG. 1C is a cross-sectional side view of the contact lens package of FIG. 1A, taken along line 1A-1A of FIG. 1A, showing the contact lens package in the vertical orientation and the unopened state.

Referring now to the drawings, FIGS. 1A-1D illustrate an example contact lens package 100 in accordance with embodiments of the present disclosure. As described, the contact lens package 100 may include a base 110, a lid 140, a contact lens 150, and packaging solution. The contact lens package 100 may have an unopened state, as shown in FIGS. 1A-1C, and an opened state, as shown in FIG. 1D. When the contact lens package 100 is in the unopened state, the contact lens 150 and the packaging solution may be housed within a cavity formed by the base 110 and the lid 140. In this manner, the contact lens 150 may be protected within the base 110 and the lid 140 and exposed to the packaging solution until the contact lens package 100 is opened for removal of the contact lens 150. When desired, a user may open the contact lens package 100 by at least partially removing the lid 140 from the base 110 to allow access to the contact lens 150. As described below, such removal of the lid 140 may allow the user to engage the contact lens 150 through a slot 130 of the base, and the engagement with the contact lens 150 may allow the user to slide the contact lens 150 out of the base 110. As shown in FIGS. 1C and 1D, the contact lens 150 may be housed within the base 110 such that a convex side of the contact lens 150 faces the slot 130. In this manner, the user may engage the convex side for removal of the contact lens 150 and subsequent placement of the contact lens 150 on the user's eye, enabling a single-touch user experience and avoiding the drawbacks of certain existing contact lens packages as discussed above.

According to the illustrated example, the base 110 may have a first end 112 (which also may be referred to as an "open end" or a "top end" in certain embodiments) and a second end 114 (which also may be referred to as a "closed end" or a "bottom end" in certain embodiments) disposed opposite one another. As shown, the base 110 may have a first side 116 (which also may be referred to as a "front side" in certain embodiments) and a second side 118 (which also may be referred to as a "back side" in certain embodiments) disposed opposite one another and each extending from the first end 112 to the second end 114. The base 110 also may have a pair of lateral sides 122 disposed opposite one another and each extending from the first end 112 to the second end 114. The base 110 may define a base cavity 124 that houses the contact lens 150 and packaging solution. As shown, the base 110 may include a number of different internal surfaces that collectively define the base cavity 124. Further, the base 110 may include a number of different external surfaces that define the external geometry of the base 110. As shown, the base 110 may include a bowl 126 that is configured to receive at least a portion of the contact lens 150 therein. In some embodiments, as shown, a shape of the bowl 126 generally may correspond to a shape of the contact lens 150. It will be appreciated that various shapes and configurations of the base 110 and respective portions thereof may be used in different embodiments, and that the illustrated embodiment is merely one example. As discussed above, the base 110 may be formed of any suitable material. In certain embodiments, the base 110 may be substantially rigid.

As shown in FIGS. 1C and 1D, the base 110 may include a slot 130 that extends through the base 110 from an internal surface 132 to an external surface 134 of the base 110, with the slot 130 being in communication with the base cavity 124. As described herein, the slot 130 may facilitate removal of the contact lens 150 from the base 110 when the contact lens package 100 is in an opened state. Various shapes and configurations of the slot 130 may be used. In some embodiments, the slot 130 may extend from the first end 112 of the base 110 toward the second end 114 of the base 110. For example, the slot 130 may extend from the first end 112 and may terminate at an intermediate region of the base 110 spaced apart from the second end 114, as shown. In some embodiments, as shown, the slot 130 may extend through the bowl 126 from the internal surface 132 to the external surface 134. In this manner, when the contact lens package 100 is in an opened state, the slot 130 may allow a user to engage the contact lens 150 through the slot 130 while the contact lens 150 is received within the bowl 126. As shown, the internal surface 132 may be a concave internal surface of the bowl 126, and the external surface 134 may be a convex external surface of the bowl 126. It will be appreciated that, according to various embodiments, the slot 130 may extend through different portions of the base 110, in addition to or instead of the bowl 126, and that the bowl 126 may be omitted in certain embodiments. As shown, the base 110 may include an opening 136 defined at the first end 112 of the base 110, and the slot 130 may be in communication with the opening 136. The opening 136 may be configured to allow the contact lens 150 to pass therethrough when the contact lens package 100 is in an opened state. In particular, as described herein, after engaging the contact lens 150 through the slot 130, the user may slide the contact lens 150 out of the base 110 through the opening 136.

As shown, the lid 140 may extend over respective surfaces of the base 110 and seal the contact lens 150 and the packaging solution within the base cavity 124 when the contact lens package 100 is in the unopened state. As previously noted, means of sealing the base and seal apparent to those skilled in the art, including the use of adhesive, glue, thermal bonding, welding such as heat, ultrasonic or laser welding, or a mechanical trap, and the like. In a preferred embodiment, the base is formed of molded polypropylene and the lid a multilayer film where the lid and base are joined via a conventional heat-sealing process to form a hermetic seal and cavity in which the lens is stored within the package. In this manner, the base 110 and the lid 140 together may form a sealed cavity for containing the contact lens 150 and the packaging solution until a user desires to open the contact lens package 100 and remove the contact lens 150 for use. In some embodiments, as shown, when the contact lens package 100 is in the unopened state, the lid 140 may extend over at least part of the first side 116 of the base 110, at least part of the first end 112 of the base 110, and at least part of the second side 118 of the base 110. For example, the lid 140 may include a first portion 142 that extends over at least part of the first side 116, a second portion 144 that extends over at least part of the first end 112, and a third portion 146 that extends over at least part of the second side 118. As shown, the first portion 142 may extend over at least part of the external surface 134 and may cover the slot 130 along the first side 116, the second portion 144 may cover the opening 136 along the first end 112, and the third portion 146 may cover the base cavity 124 along the second side 118. When the contact lens package 100 is in the unopened state, respective portions of the lid 140 may be sealed to respective adjacent portions of the base 110 such that the contact lens 150 and the packaging solution are contained within the cavity formed by the base 110 and the lid 140. The seal between the lid 140 and the base 110 may be at least partially broken when the contact lens package 100 is transitioned from the unopened state to an opened state for removal of the contact lens 150. As discussed above, the lid 140 may be formed of any suitable material. In certain embodiments, as shown, the lid 140 may be flexible.

FIGS. 2A-2C illustrate an example method of opening the contact lens package 100 in accordance with embodiments of the present disclosure. As noted above, the contact lens package 100 may be provided and stored in the unopened state, as shown in FIGS. 1A-1C, until a user desires to open the package 100. With the contact lens package 100 in the unopened state, the user may hold the base 110 and at least partially remove the lid 140 from the base 110, as shown in FIG. 2A. For example, the user may grasp and an end region of the first portion 142 and pull the lid 140 away from the base 110. In this manner, at least a portion of the seal between the lid 140 and the base 110 may be broken. In some embodiments, as shown, the contact lens package 100 may be held in a vertical orientation while the lid 140 is at least partially removed from the base 110. Alternatively, in some embodiments, the contact lens package 100 may be held in a horizontal orientation while the lid 140 is at least partially removed from the base 110. In some embodiments, as shown, the lid 140 may be removed from the external surface 134 of the base 110 such that the slot 130 is no longer covered by the lid 140 along the first side 116. Additionally, as shown, the lid 140 may be removed from the base 110 such that the opening 136 is no longer covered by the lid 140 along the first end 112. Further, as shown, the lid 140 may be removed from the base 110 such that at least a portion of the base cavity 124 is no longer covered by the lid 140 along the second side 118. In some embodiments, the lid 140 may be entirely removed from the base 110.

After at least partially removing the lid 140 from the base 110, the user may engage the contact lens 150 through the slot 130 of the base 110 with one of the user's fingers while the contact lens 150 resides within the base cavity 124, as shown in FIG. 2B. In some embodiments, as shown, the user may engage the contact lens 150 through the slot 130 while the contact lens package 100 is held in the horizontal orientation. According to the illustrated embodiment in which the convex surface of the contact lens 150 faces the slot 130, the user may engage the convex surface of the contact lens 150 through the slot 130. The user then may slide the contact lens 150 out of the base cavity 124 via the engagement through the slot 130, as shown in FIG. 2C. In particular, the user may slide the contact lens 150 through the uncovered opening 136 at the first end 112 of the base 110. In this manner, with a single touch, the contact lens 150 may be conveniently removed from the base 110 and held on the user's finger in the desired concave-side-up orientation, ready for positioning on the user's eye.

The foregoing description, for purposes of explanation, used specific nomenclature to provide a thorough understanding of the described embodiments. However, it will be apparent to one skilled in the art that many of the specific details are not required in order to practice the described embodiments. Thus, the foregoing descriptions of the specific embodiments described herein are presented for the purposes of illustration and description. They are not targeted to be exhaustive or to limit the embodiments to the precise forms disclosed. It will be apparent to one of ordinary skill in the art that many modifications and variations are possible in view of the above teachings.

The Summary and Abstract sections may set forth one or more but not all exemplary embodiments of the present invention as contemplated by the inventors, and thus, are not intended to limit the present invention and the appended claims in any way.

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The packages of the present invention may be manufactured using known materials and processes. The packaging materials may be virgin, recycled or a combination thereof. The volume within the package cavity can vary depending on the design selected.

Not all the features described herein need to be incorporated into every package, and those of skill in the art, using the teachings herein, can combine the features to provide a wide variety of improved contact lens packages. In summary, the contact lens packages of the present invention incorporate several novel functionalities which may be combined in a wide variety of combinations as described herein to provide the desired improved and/or single touch packaging. The breadth and scope of the present invention should not be limited by any of the above-described exemplary embodiments but should be defined only in accordance with the following embodiments and their equivalents.

Aspects of the invention may include the following embodiments:

1. A contact lens package comprising:

a base comprising:

a base cavity that houses a contact lens and packaging solution; and a slot extending through the base from an internal surface to an external surface of the base and in communication with the base cavity; and a lid connected to the base, wherein the lid extends over the external surface of the base and covers the slot when the package is in an unopened state.

2. The contact lens package of embodiment 1, wherein the lid does not cover the slot when the package is in an opened state, such that the contact lens is accessible to a user through the slot when the package is in the opened state.

3. The contact lens package of embodiment 1 or embodiment 2, wherein the base cavity houses the contact lens such that a convex surface of the contact lens faces the slot.

4. The contact lens package of any one of embodiments 1-3, wherein the base comprises a bowl that forms at least a portion of the base cavity, and wherein the slot extends through the bowl from the internal surface to the external surface of the base.

5. The contact lens package of embodiment 4, wherein the slot extends from an end of the base and terminates at an intermediate region of the bowl.

6. The contact lens package of any one of embodiments 1-5, wherein the slot extends from an end of the base and terminates at an intermediate region of the base.

7. The contact lens package of embodiment 6, wherein the lid extends over the end of the base when the package is in the unopened state, and wherein the lid does not extend over the end of the base when the package is in an opened state.

8. The contact lens package of embodiment 6 or embodiment 7, wherein the end of the base is open and configured to allow the contact lens to pass therethrough when the package is in an opened state.

9. The contact lens package of any one of embodiments 1-8, wherein the internal surface is a concave surface, and wherein the external surface is a convex surface.

10. The contact lens package of any one of embodiments 1-9, wherein the base is substantially rigid, and wherein the lid is flexible.

11. A contact lens package comprising:

a base comprising:

a base cavity that houses a contact lens and packaging solution; and a slot extending through the base from an internal surface to an external surface of the base and in communication with the base cavity, wherein the base cavity houses the contact lens such that a convex surface of the contact lens faces the slot; and a lid connected to the base.

12. The contact lens package of embodiment 11, wherein the lid extends over the external surface of the base and covers the slot when the package is in an unopened state.

13. The contact lens package of embodiment 12, wherein the lid does not cover the slot when the package is in an opened state, such that the contact lens is accessible to a user through the slot when the package is in the opened state.

14. The contact lens package of any one of embodiments 11-13, wherein the base comprises a bowl that forms at least a portion of the base cavity, and wherein the slot extends through the bowl from the internal surface to the external surface of the base.

15. The contact lens package of embodiment 14, wherein the slot extends from an end of the base and terminates at an intermediate region of the bowl.

16. The contact lens package of any one of embodiments 11-15, wherein the slot extends from an end of the base and terminates at an intermediate region of the base.

17. The contact lens package of embodiment 16, wherein the lid extends over the end of the base when the package is in the unopened state, and wherein the lid does not extend over the end of the base when the package is in an opened state.

18. The contact lens package of embodiment 16 or embodiment 17, wherein the end of the base is open and configured to allow the contact lens to pass therethrough when the package is in an opened state.

19. The contact lens package of any one of embodiments 11-18, wherein the internal surface is a concave surface, and wherein the external surface is a convex surface.

20. The contact lens package of any one of embodiments 11-19, wherein the base is substantially rigid, and wherein the cover is flexible.

21. A method of packaging a contact lens, the method comprising:

providing a base comprising a base cavity and a slot extending through the base from an internal surface to an external surface of the base and in communication with the base cavity;

disposing a contact lens and packaging solution within the base cavity; and connecting a lid to the base such that the lid extends over the external surface of the base and covers the slot.

22. The method of embodiment 21, wherein the contact lens is disposed within the base cavity such that a convex surface of the contact lens faces the slot.

23. The method of embodiment 21 or embodiment 22, wherein the base comprises a bowl that forms at least a portion of the base cavity, and wherein the slot extends through the bowl from the internal surface to the external surface of the base.

24. The method of any one of embodiments 21-23, wherein the slot extends from an end of the base and terminates at an intermediate region of the base, and wherein the lid extends over the end of the base.

25. The method of any one of embodiments 21-24, wherein the internal surface is a concave surface, and wherein the external surface is a convex surface.

26. A method of opening a contact lens package, the method comprising:

holding a base of the package, the base comprising:

a base cavity that houses a contact lens and packaging solution; and a slot extending through the base from an internal surface to an external surface of the base; and at least partially removing a lid of the package from the external surface of the base such that the slot is not covered by the lid;

engaging the contact lens through the slot; and sliding the contact lens out of the base cavity via the engagement through the slot.

27. The method of embodiment 26, wherein the base cavity houses the contact lens such that a convex surface of the contact lens faces the slot.

28. The method of embodiment 26 or embodiment 27, wherein the base comprises a bowl that forms at least a portion of the base cavity, and wherein the slot extends through the bowl from the internal surface to the external surface of the base.

29. The method of any one of embodiments 26-28, wherein the slot extends from an open end of the base and terminates at an intermediate region of the base, and wherein sliding the contact lens out of the base cavity comprises sliding the contact lens through the open end of the base.

30. The method of any one of embodiments 26-29, wherein the internal surface is a concave surface, and wherein the external surface is a convex surface.

What is claimed is:

1. A contact lens package comprising:

a base comprising:

a base cavity that houses a contact lens and packaging solution;

an opening at an end of the base cavity; and a slot extending from the opening to an intermediate region of the base cavity, wherein the slot extends through the base from an internal surface to an external surface of the base and is in communication with the base cavity; and a lid connected to the base, wherein the lid extends over opposing sides of the lens and covers both the slot and the base cavity when the package is in an unopened state;

wherein the slot is configured such that a convex side of the contact lens is accessible to a user through the slot when the package is in the opened state.

2. The contact lens package of claim 1, wherein the lid does not cover the slot when the package is in an opened state, such that the contact lens is accessible to a user through the slot when the package is in the opened state.

3. The contact lens package of claim 1, wherein the base cavity houses the contact lens such that a convex surface of the contact lens faces the slot.

4. The contact lens package of claim 1 wherein the base comprises a bowl that forms at least a portion of the base cavity, and wherein the slot extends through the bowl from the internal surface to the external surface of the base.

5. The contact lens package of claim 1, wherein the base comprises a bowl that forms at least a portion of the base cavity, and wherein the slot extends from an end of the base and terminates at an intermediate region of the bowl.

6. The contact lens package of claim 1, wherein the slot extends from an end of the base and terminates at an intermediate region of the base.

7. The contact lens package of claim 1, wherein the lid extends over the end of the base when the package is in the unopened state, and wherein the lid does not extend over the end of the base when the package is in an opened state.

8. The contact lens package of claim 1, wherein the end of the base is open and configured to allow the contact lens to pass therethrough when the package is in an opened state.

9. The contact lens package of claim 1, wherein the internal surface is a concave surface, and wherein the external surface is a convex surface.

10. The contact lens package of claim 1, wherein the base is substantially rigid, and wherein the lid is flexible.

11. A contact lens package comprising:

a base comprising:

a base cavity that houses a contact lens and packaging solution;

an opening at an end of the base cavity; and a slot extending from the opening to an intermediate region of the base cavity, wherein the slot extends through the base from an internal surface to an external surface of the base and is in communication with the base cavity, wherein the base cavity houses the contact lens such that a convex surface of the contact lens faces the slot; and a lid connected to the base, wherein the lid extends over opposing sides of the lens and covers both the slot and the base cavity when the package is in an unopened state.

12. The contact lens package of claim 11, wherein the lid extends over the external surface of the base and covers the slot when the package is in an unopened state.

13. The contact lens package of claim 11, wherein the lid does not cover the slot when the package is in an opened state, such that a convex side of the contact lens is accessible to a user through the slot when the package is in the opened state.

14. The contact lens package of claim 11, wherein the base comprises a bowl that forms at least a portion of the base cavity, and wherein the slot extends through the bowl from the internal surface to the external surface of the base.

15. The contact lens package of claim 11, wherein the base comprises a bowl that forms at least a portion of the base cavity, and wherein the slot extends from an end of the base and terminates at an intermediate region of the bowl.

16. The contact lens package of claim 11, wherein the slot extends from an end of the base and terminates at an intermediate region of the base.

17. The contact lens package of claim 11, wherein the lid extends over the end of the base when the package is in the unopened state, and wherein the lid does not extend over the end of the base when the package is in an opened state.

18. The contact lens package of claim 11, wherein the end of the base is open and configured to allow the contact lens to pass therethrough when the package is in an opened state.

19. The contact lens package of claim 11, wherein the base is substantially rigid, and wherein the cover is flexible.

* * * * *